US008701247B1

(12) United States Patent
Shargh

(10) Patent No.: US 8,701,247 B1
(45) Date of Patent: Apr. 22, 2014

(54) HINGE PIN WITH LUBRICATION CHANNEL

(71) Applicant: Hossein Molaie Shargh, Corona, CA (US)

(72) Inventor: Hossein Molaie Shargh, Corona, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 0 days.

(21) Appl. No.: 13/691,292

(22) Filed: Nov. 30, 2012

Related U.S. Application Data

(63) Continuation-in-part of application No. 29/437,101, filed on Nov. 13, 2012.

(51) Int. Cl.
*E05D 11/02* (2006.01)
*E05D 5/10* (2006.01)

(52) U.S. Cl.
USPC ..... 16/274; 16/386

(58) Field of Classification Search
USPC ..... 16/274, 273, 386
See application file for complete search history.

(56) References Cited

U.S. PATENT DOCUMENTS

| | | | | | |
|---|---|---|---|---|---|
| 692,633 | A | * | 2/1902 | Daniels | 16/274 |
| 1,168,568 | A | * | 1/1916 | Rudolff | 16/274 |
| 1,433,095 | A | * | 10/1922 | Peary | 16/274 |
| 1,444,695 | A | * | 2/1923 | McNeill | 16/274 |
| 1,800,311 | A | * | 4/1931 | McKinney, Jr. | 16/274 |
| 1,898,936 | A | * | 2/1933 | Brawley | 16/274 |
| 2,053,864 | A | * | 9/1936 | Cook et al. | 16/274 |
| 2,096,311 | A | | 10/1937 | Strough | |
| 2,134,993 | A | | 11/1938 | Wimmenauer | |
| 2,179,931 | A | | 11/1939 | Harris | |
| 2,588,216 | A | | 3/1952 | De Graaf | |
| 2,750,620 | A | | 6/1956 | Clarke | |
| 2,890,479 | A | | 6/1959 | Falk | |
| 3,181,197 | A | | 5/1965 | Sperber | |
| 3,997,274 | A | | 12/1976 | Iverson | |
| 4,253,275 | A | | 3/1981 | Killough | |
| 4,679,285 | A | | 7/1987 | Ballantyne | |
| 5,771,538 | A | | 6/1998 | Huppert, Sr. | |
| 6,393,662 | B1 | | 5/2002 | Huang et al. | |
| 7,703,577 | B1 | | 4/2010 | Zach et al. | |
| 8,191,205 | B2 | | 6/2012 | Forrest | |
| 2002/0116787 | A1 | | 8/2002 | Miller et al. | |
| 2008/0115328 | A1 | * | 5/2008 | Tomaini et al. | 16/386 |
| 2009/0307873 | A1 | | 12/2009 | Chen | |
| 2011/0061196 | A1 | | 3/2011 | Cox | |
| 2012/0079683 | A1 | | 4/2012 | Spragg | |

FOREIGN PATENT DOCUMENTS

| | | | |
|---|---|---|---|
| CN | 1800574 A | * | 7/2006 |
| DE | 2353370 A | * | 5/1975 |
| DE | 2407472 A | * | 8/1975 |
| DE | 2547218 A | * | 5/1977 |

* cited by examiner

*Primary Examiner* — Chuck Mah
(74) *Attorney, Agent, or Firm* — Klein, O'Neill & Singh, LLP

(57) ABSTRACT

A hinge pin includes a shaft defining a clearance surface and joined at one end to a head. A channel between the head and the clearance surface is configured to provide a lubricant path between the head and the clearance surface. In one embodiment, the head has an annular outer portion and a concave central portion, and the channel is provided by a radial slot extending from the central portion through the annular outer portion, and a contiguous axial slot extending downward from the radial slot to the clearance surface. The central portion of the head is configured to receive a small volume of lubricant, while the channel provides a path that allows the lubricant to flow from the head to the clearance surface of the shaft.

10 Claims, 3 Drawing Sheets

HINGE PIN WITH LUBRICATION CHANNEL

CROSS-REFERENCE TO RELATED APPLICATION

This application is a Continuation-in-Part of co-pending U.S. Design application No. 29/437,101; filed Nov. 13, 2012, and commonly assigned to the assignee of this application.

FEDERALLY SPONSORED RESEARCH OR DEVELOPMENT

Not Applicable

BACKGROUND

This disclosure relates to door hinges. More particularly, it relates to a hinge pin for a door hinge assembly, wherein the hinge pin includes a channel for the introduction of a lubricant from the head of the hinge pin into the narrow spaces between the bearing surfaces of the hinge plate knuckles that rotate around the hinge pin shaft.

Conventional door hinge assemblies, as disclosed, for example, in U.S. Pat. No. 8,191,205, include a first hinge plate with an inner edge and a second hinge plate having an inner edge adjacent the inner edge of the first plate. A first set of hollow tubular knuckles extends from the inner edge of the first plate, and a second set of hollow tubular knuckles extends from the inner edge of the second plate. The respective knuckles of the first and second sets of knuckles are interdigitated so that they are aligned along a pivot axis to form a continuous passageway configured to receive the shaft of a hinge pin that pivotably joins the hinge plates to each other along the pivot axis. When thus joined, the hinge plates are rotatable about the axis defined by the hinge pin shaft.

In the typical door hinge assembly, as described above, the hinge pin shaft is usually lubricated on assembly. Because the clearance between the interdigitated knuckles may be quite tight, however, little of the lubricant may actually migrate to the metal-on-metal bearing surfaces between adjacent knuckles. Thus, over time, the hinge may begin to squeak when the door is opened and closed. Curing this problem usually necessitates the removal of pin from the hinge assembly, which often requires the removal of the door as well. Accordingly, a hinge assembly construction has been sought that provides for lubrication of these bearing surfaces without the need for any disassembly.

SUMMARY

Broadly, the subject of the present disclosure is a hinge pin comprising a cylindrical shaft having a clearance surface and an upper end, a head joined to the upper end, and a channel between the head and the clearance surface that is configured to provide a lubricant path between the head and the clearance surface of the shaft. In one embodiment, the head comprises an annular outer portion and a recessed or concave central portion, and the channel is provided by a radial slot extending from the central portion through the annular outer portion, and a contiguous axial slot extending downward from the radial slot to the clearance surface. In other embodiments, the channel may be provided by an axial bore through the head that communicates with a radial bore through the shaft. In accordance with this disclosure, the central portion of the head is configured to receive a small volume of lubricant, while the channel formed between the central portion of the head and the clearance surface of the shaft provides a path that allows the lubricant to flow down along the clearance surface of the shaft, and from there to the narrow spaces between the bearing surfaces of adjacent knuckles.

DETAILED DESCRIPTION

Figure 2:
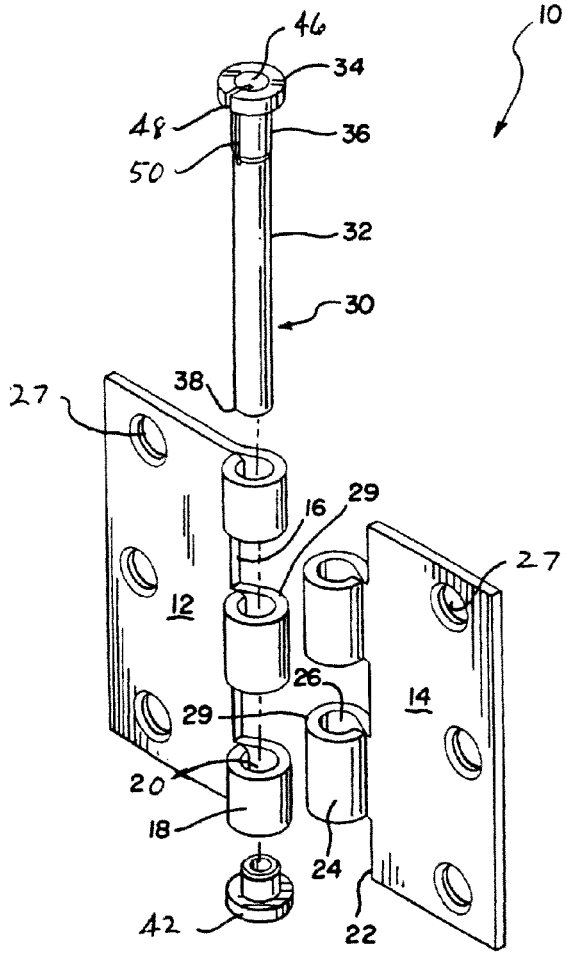
FIG. 2 is an exploded perspective view of the door hinge assembly of FIG. 1.
Figure 3:
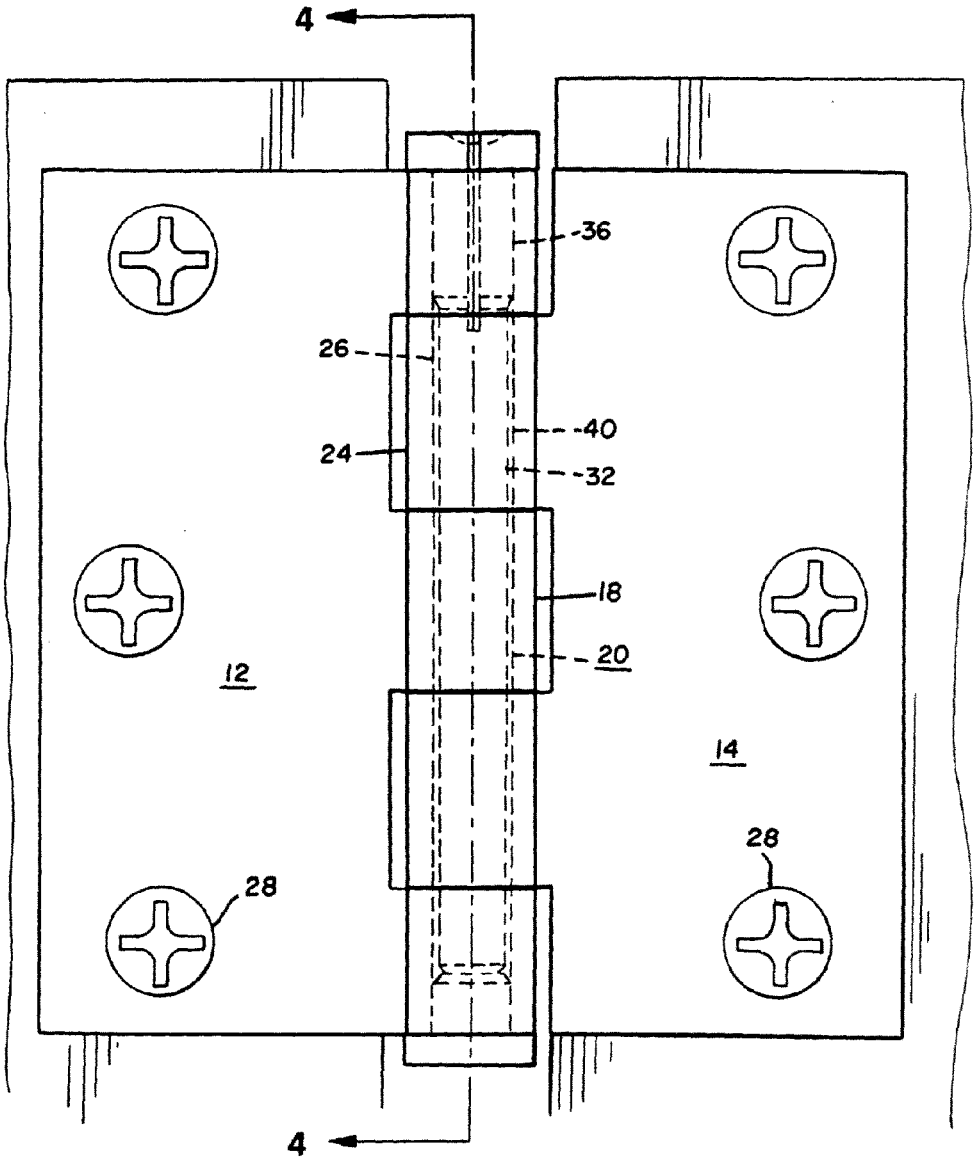
FIG. 3 is an elevational view, partially in phantom, of the door hinge assembly of FIG. 1.

Referring to the drawings, a door hinge assembly 10 includes a first hinge plate 12 and a second hinge plate 14. With reference to FIG. 2, the first hinge plate 12 has an inner edge 16 from which extends a first set of hollow tubular knuckles 18, each defining a bore 20. The second hinge plate 14 has an inner edge 22 from which extends a second set of hollow tubular knuckles 24, each defining a bore 26. The knuckles 24 of the second set are configured to fit between the knuckles 18 of the first set, so that the first and second sets of knuckles may be interdigitated, as shown in FIGS. 1-3.

Figure 1:
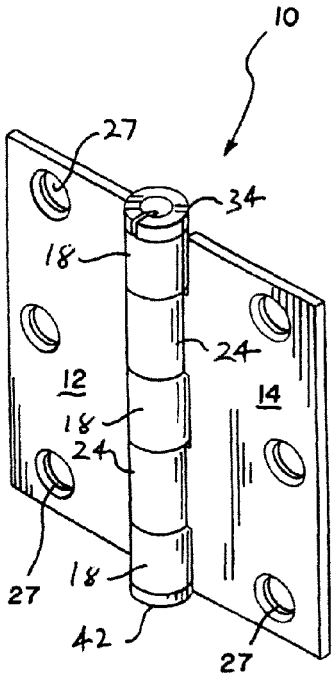
FIG. 1 is a perspective view of a door hinge assembly incorporating a hinge pin in accordance with an embodiment of this disclosure.

With reference to FIG. 1, as is well-known, each of the hinge plates 12, 14 is provided with a plurality of apertures 27, which accommodate fasteners, such as screws 28 (FIG. 3) to attach the hinge assembly 10 to a door (not shown) and a door frame (not shown). Adjacent knuckles 18, 24 are spaced sufficiently close to each other to form essentially metal-to-metal contacting or bearing surfaces 29 (FIG. 2).

The assembly 10 further comprises a hinge pin 30 including a cylindrical shaft having a main portion 32 that defines a clearance surface. The main shaft portion 32 has an upper or proximal end that is joined to a head 34 by an enlarged diameter neck portion 36, and it extends to a lower or distal end 38. Thus, the neck portion 36 extends between the head 34 and a juncture with the main shaft portion 32. When the knuckles 18, 24 are interdigitated, their respective bores 20, 26 are in axial alignment, providing a continuous passageway 40 (FIG. 3) through which the hinge pin shaft 32 extends. The passageway 40 thus formed is of a slightly larger diameter than the hinge pin shaft 32, thereby creating a clearance space between the clearance surface of the main portion of the shaft 32 and the interior surfaces of the knuckles 18, 24 that define the respective bores 20, 26. The neck portion 36 of the hinge pin shaft, by contrast, is sized to provide an interference fit within the bore 20 of the uppermost one of the first set of knuckles 18, so that the hinge pin 30 is fixed relative to the first hinge plate 12. As will be appreciated from the following description of the lubrication channel, however, the juncture between the main shaft portion 32 and neck portion 36 should be above the first knuckle-to-knuckle interface 41 (FIGS. 4 and 5), so that the passageway 40 begins above the interface 41.

Figure 4:
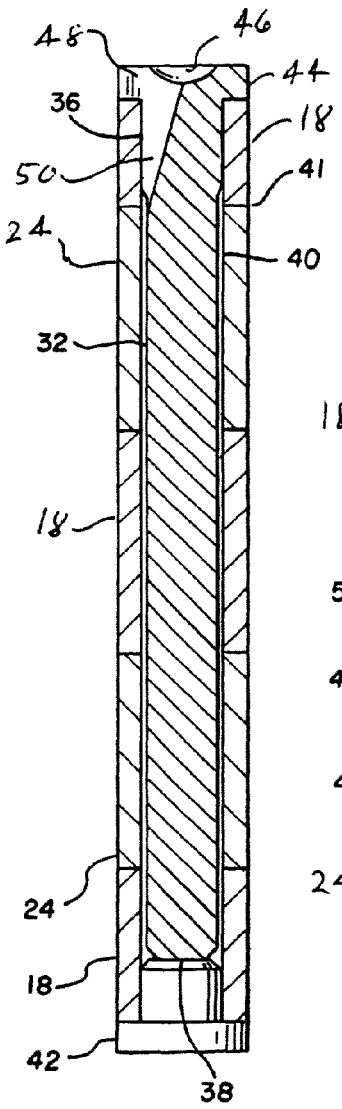
FIG. 4 is a cross-sectional view taken along line 4-4 of FIG. 3.

With reference to FIG. 4, the main shaft portion 32 extends down the passageway 40 to a short distance from the bottom end of the passageway 40, past the juncture between the lowermost knuckle 18 of the first set and the lowermost knuckle 24 of the second set. The hinge pin shaft thus defines a pivot axis around which the hinge plates 12, 14 are rotatable. A decorative bottom cap 42 may advantageously be inserted into the bottom of the passageway 40 to abut against, or be in close proximity to, the lower end 38 of the main shaft portion 32. The diameter of the bottom cap 42 is advantageously such as to provide an interference fit within the passageway 40.

Figure 5:
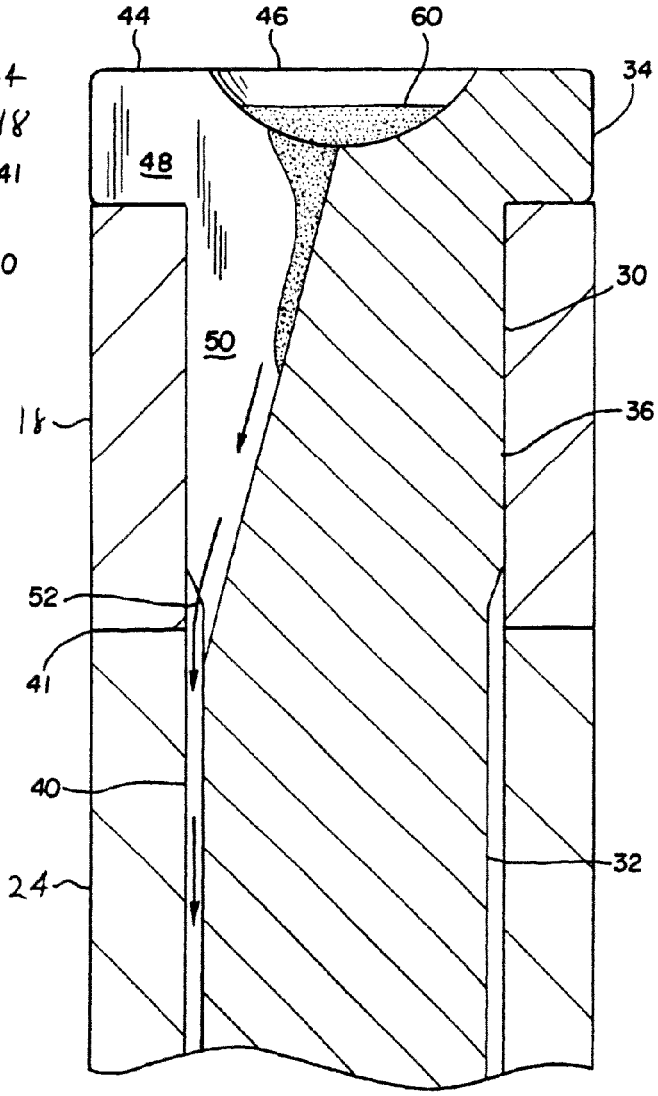
FIG. 5 is a detailed cross-sectional view of upper portion of FIG. 4, showing the flow of lubricant along the lubricant path or channel provided by a hinge pin in accordance with an embodiment of this disclosure.

With reference to FIG. 5, the head 34 of the hinge pin 30 includes an annular outer portion 44 and a recessed or concave central portion 46. A lubricant channel is formed between the central portion 46 of the head 34 and the clearance surface of the main shaft portion 32. In one embodiment, as illustrated in the drawing figures, the lubricant channel is provided by a radial slot 48 extending from the central portion 46 through the annular outer portion 44, and a contiguous axial slot 50 extending distally from the head 34 along the neck portion 36 of the shaft. As best shown in FIG. 5, the axial slot 50 is slanted so as to have a gradually decreasing depth from the annular outer portion 44 of the hinge pin head 34 to the slot's distal termination at the main portion 32 of the shaft. Thus, the axial slot 50, at its uppermost or proximal end, has a depth that is essentially equal to the radius of the head 34; that is, it extends inwardly to the approximate center point of the central portion 46 of the head 34. At its lowermost (distal) end, the axial slot 50 terminates at an angled juncture 52 with the clearance surface of the main shaft portion 32, advantageously just below the juncture of the neck portion 36 and the main shaft portion 32. The exact position of the angled juncture 52 along the length of the main shaft portion 32 is a matter of design choice. In some embodiments, the angled juncture 52 may be formed with the neck portion 36 of the pin shaft.

As seen in FIG. 5, the central portion 46 of the head 34 is configured to receive a small volume (a few drops) of a liquid lubricant 60. The lubricant 60 flows from the central portion 46, down the lubricant channel formed by the slots 48, 50, and into the passageway 40 defined between the clearance surface of the main shaft portion 32 and the interior surfaces of the knuckles 18, 24. From the passageway 40, the lubricant can seep into the tight spaces between the bearing surfaces of adjacent knuckles.

While a particular specific embodiment has been described above and illustrated in the drawings, it will be appreciated that alternative embodiments may suggest themselves to those skilled in the pertinent arts. For example, as briefly mentioned above, other embodiments may include a lubricant channel that is provided by an axial bore through the central portion of the head and a radial passage from the axial bore to the clearance surface of the main portion of the hinge pin shaft. These and other embodiments should be considered within the spirit and scope of the present disclosure.

What is claimed is:

1. A hinge pin, comprising:

a cylindrical shaft having a clearance surface and an upper end;

a head at the upper end and including an annular outer portion and a concave central portion; and a channel between the head and the clearance surface, wherein the channel is configured to provide a lubricant path between the head and the clearance surface and includes a radial slot extending from the central portion through the annular outer portion, and an axial slot extending downward from the radial slot to the clearance surface.

2. The hinge pin of claim 1, wherein the shaft includes a main portion defining the clearance surface, and an enlarged-diameter neck portion between the head and the main portion, the neck forming a juncture with the main portion, and wherein the channel has a lower termination at the clearance surface just below the juncture of the neck portion and the main portion.

3. The hinge pin of claim 2, wherein the channel has a decreasing depth from the head to the lower termination.

4. The hinge pin of claim 1, wherein the shaft includes a main portion defining the clearance surface, and an enlarged-diameter neck portion between the head and the main portion, the neck forming a juncture with the main portion, and wherein the axial slot has a lower termination at the clearance surface just below the juncture of the neck portion and the main portion.

5. The hinge pin of claim 4, wherein the axial slot has a decreasing depth from the radial slot to the lower termination.

6. A hinge assembly, comprising:

a first hinge plate with an inner edge;

a second hinge plate having an inner edge adjacent the inner edge of the first plate;

a first set of hollow tubular knuckles extending from the inner edge of the first plate and a second set of hollow knuckles extending from the inner edge of the second plate, wherein the first and second sets of knuckles are interdigitated to define a passageway aligned along a pivot axis, the passageway having an interior surface; and a hinge pin having a cylindrical shaft defining a clearance surface, the shaft extending through the passageway and pivotably joining the hinge plates to each other along the pivot axis;

wherein a clearance space is defined between the clearance surface of the shaft and the interior surface of the passageway; and wherein the hinge pin further comprises:

a head at one end of the shaft and including annular outer portion and a concave central portion; and a channel between the head and the clearance surface of the shaft, wherein the channel is configured to provide a lubricant path between the head and the clearance surface and includes a radial slot extending from the central portion through the annular outer portion, and an axial slot extending downward from the radial slot to the clearance surface.

7. The hinge assembly of claim 6, wherein the shaft includes a main portion defining the clearance surface, and an enlarged-diameter neck portion between the head and the main portion, the neck forming a juncture with the main portion, and wherein the channel has a lower termination at the clearance surface just below the juncture of the neck portion and the main portion.

8. The hinge assembly of claim 7, wherein the channel has a decreasing depth from the head to the lower termination.

9. The hinge assembly of claim 6, wherein the shaft includes a main portion defining the clearance surface, and an enlarged-diameter neck portion between the head and the main portion, the neck forming a juncture with the main portion, and wherein the axial slot has a lower termination at the clearance surface just below the juncture of the neck portion and the main portion.

10. The hinge assembly of claim 9, wherein the axial slot has a decreasing depth from the radial slot to the lower termination.

* * * * *